US006319151B1

(12) United States Patent
Sugimoto

(10) Patent No.: US 6,319,151 B1
(45) Date of Patent: Nov. 20, 2001

(54) THREAD WOUND GOLF BALL

(75) Inventor: Kazushige Sugimoto, Hyogo-ken (JP)

(73) Assignee: Sumitomo Rubber Industries, Ltd., Hyogo-ken (JP)

( * ) Notice: Subject to any disclaimer, the term of this patent is extended or adjusted under 35 U.S.C. 154(b) by 0 days.

(21) Appl. No.: 09/444,916

(22) Filed: Nov. 24, 1999

(30) Foreign Application Priority Data

Nov. 26, 1998 (JP) ..... 10-335745
Aug. 30, 1999 (JP) ..... 11-243105

(51) Int. Cl.[7] ..... A63B 37/06
(52) U.S. Cl. ..... 473/357; 473/356; 473/363; 473/365
(58) Field of Search ..... 473/356–366

(56) References Cited

U.S. PATENT DOCUMENTS 5,628,699 * 5/1997 Maruko et al. ..... 473/363
5,674,137 * 10/1997 Maruko et al. ..... 473/354
5,762,568 * 6/1998 Kato ..... 473/365
5,766,096 6/1998 Maruko et al. .
5,772,530 6/1998 Kato .
5,792,009 * 8/1998 Maruko ..... 473/359
5,830,086 * 11/1998 Hayashi et al. ..... 473/376
5,976,034 * 11/1999 Kato et al. ..... 473/363
6,054,550 * 4/2000 Umezwa et al. ..... 473/365
6,095,932 * 8/2000 Umezawa et al. ..... 473/356

FOREIGN PATENT DOCUMENTS 8-98902 4/1996 (JP) .
8-224323 9/1996 (JP) .
8-332248 12/1996 (JP) .
9-173505 7/1997 (JP) .

* cited by examiner

*Primary Examiner*—Mark S. Graham
*Assistant Examiner*—Raeann Gorden
(74) *Attorney, Agent, or Firm*—Birch, Stewart, Kolasch & Birch, LLP

(57) ABSTRACT

The present invention provides a thread wound golf ball having soft and good shot feel at the time of hitting, excellent durability and excellent flight performance. The present invention related to a thread wound golf ball comprising a thread wound core composed of a center and a thread rubber layer formed on the center, and a cover composed of an inner cover formed on the thread rubber layer and an outer cover formed on the inner cover, wherein the outer cover has higher hardness than the inner cover, and has a Shore D hardness of not less than 65.

9 Claims, 1 Drawing Sheet

THREAD WOUND GOLF BALL

FIELD OF THE INVENTION

The present invention relates to a thread wound golf ball. More particularly, it relates to a thread wound golf ball having soft and good shot feel at the time of hitting, excellent durability and excellent flight performance.

BACKGROUND OF THE INVENTION

Various kinds of golf balls are commercially selling, because various kinds of characteristics, such as long flight distance, excellent controllability with approach shots, and good shot feel at the time of hitting, are required by golfers. Amateur golfers generally desire and require long flight distance and good shot feel in the characteristics of golf balls and therefore tend to employ golf balls which are soft and have long flight distance. In order to extend the flight distance, it is required to restrain the spin amount to be as low as possible. It is also required to increase the deformation amount of the golf ball, in order to obtain a soft and good shot feel.

Golf balls are typically classified into thread wound golf balls and solid golf balls (e.g. two-piece golf ball, three-piece golf ball and the like). The thread wound golf balls have soft shot feel in comparison with the solid golf balls. In order to impart shot feel equal to the thread wound golf balls to the solid golf balls, many improvements have recently been made to the solid golf balls. However, the thread wound golf balls inherently have good shot feel because of the presence of a soft thread wound layer and the improvement of shot feel on the solid golf balls has not been sufficiently accomplished.

The thread wound golf ball is generally composed of a center, a thread wound layer formed on the center and a balata cover formed on the thread wound layer. The balata-covered thread wound golf ball has very good shot feel, but has poor durability, so that the cover is easily cut by an iron shot. Instead of the balata cover, an ionomer cover has also been proposed to improve durability. The use of the ionomer cover properly improves the durability of the thread wound golf ball and also imparts longer flight distance than the balata-covered thread wound golf ball. However, the ionomer-covered thread wound golf ball adversely affects the shot feel inherent to the thread wound golf ball.

In order to impart good durability to the thread wound golf ball while maintaining soft and good shot feel, it has been proposed in Japanese Patent Kokai Publication Nos. 98902/1996, 224323/1996, 332248/1996, 173505/1997 and the like that the cover of the thread wound golf ball is formed into two-layer structure, i.e., inner cover layer and outer cover layer. In the proposed golf balls, the inner cover layer is made harder and the outer cover layer is made softer, to achieve a balance of spin amount and durability. However, when the outer cover layer is softer than the inner cover layer, the resultant golf ball has high durability, but has high spin amount, which results in a reduction of flight distance.

OBJECTS OF THE INVENTION

A main object of the present invention is to provide a thread wound golf ball having soft and good shot feel at the time of hitting, excellent durability and excellent flight performance.

According to the present invention, the object described above has been accomplished by employing a thread wound golf ball comprising a thread wound core composed of a center and a thread rubber layer, and a cover having a two-layer structure, controlling the hardness of the outer cover to higher than that of the inner cover, and adjusting a hardness of the cover, the diameter of the center, and the deformation amount of the center, core and ball to a specified range, thereby providing a thread wound golf ball having a soft and good shot feel at the time of hitting, excellent durability and excellent flight performance.

This object as well as other objects and advantages of the present invention will become apparent to those skilled in the art from the following description with reference to the accompanying drawings.

SUMMARY OF THE INVENTION

Figure 1:
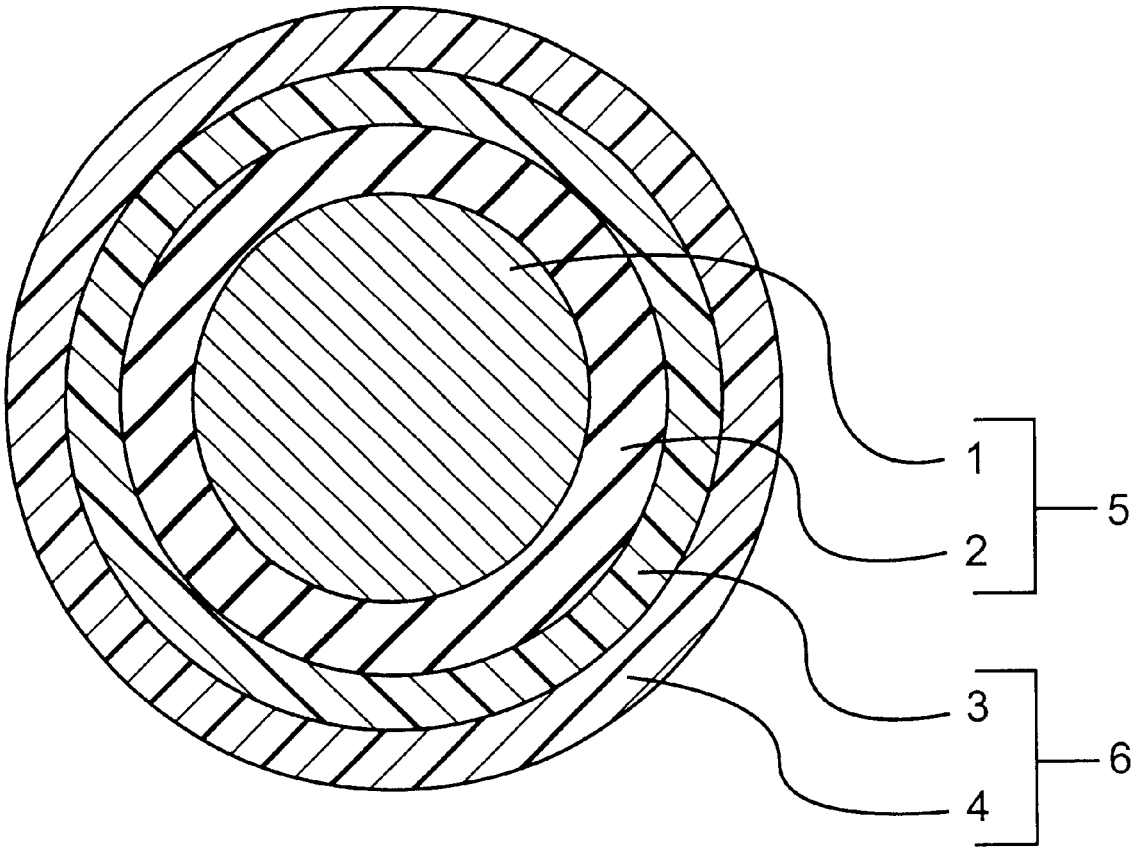
FIG. 1 is a schematic cross section illustrating one embodiment of the golf ball of the present invention.

The present invention provides a thread wound golf ball comprising a thread wound core composed of a center and a thread rubber layer formed on the center, and a cover composed of an inner cover formed on the thread rubber layer and an outer cover formed on the inner cover, wherein the outer cover has higher hardness than the inner cover, and has a Shore D hardness of not less than 65.

In order to suitably practice the present invention, it is preferable that the center has a diameter of 27 to 36 mm, and a ratio of deformation amount of the core to deformation amount of the center when applying from an initial load of 10 kgf to a final load of 130 kgf is not more than 0.9, and the golf ball has a deformation amount of 2.8 to 4.5 mm when applying from an initial load of 10 kgf to a final load of 130 kgf.

DETAILED DESCRIPTION OF THE INVENTION

The thread wound golf ball of the present invention will be explained hereinafter with reference to the accompanying drawings. FIG. 1 is a schematic cross section illustrating one embodiment of the golf ball of the present invention. As shown in FIG. 1, the golf ball of the present invention comprises a thread wound core 5 composed of a center 1 and a thread rubber layer 2 formed on the center, and a cover 6 formed on the core 5. The cover 6 has two-layer structure composed of an inner cover 3 and an outer cover 4 formed on the inner cover.

The center 1 of the golf ball of the present invention is formed from a rubber composition comprising a base rubber, a co-crosslinking agent, an organic peroxide, a filler and the like.

The base rubber may be natural rubber and/or synthetic rubber, which has been conventionally used for solid golf balls. Preferred is high-cis polybutadiene rubber containing a cis1,4 bond of not less than 40%, preferably not less than 80%. The polybutadiene rubber may be mixed with natural rubber, polyisoprene rubber, styrene-butadiene rubber, ethylene-propylene-diene rubber (EPDM), and the like.

The co-crosslinking agent may be a metal salt of α,β-unsaturated carboxylic acid, particularly mono- or di-valent metal salts, such as zinc or magnesium salts of α,β-unsaturated carboxylic acids having 3 to 8 carbon atoms (e.g. acrylic acid, methacrylic acid, etc.). The preferred co-crosslinking agent is zinc acrylate because it imparts high rebound characteristics to the resulting golf ball. The amount of the co-crosslinking agent may be 15 to 35 parts by weight, preferably 15 to 30 parts by weight, based on 100 parts by weight of the base rubber. When the amount of the co-crosslinking agent is larger than 35 parts by weight, the center is too hard, and the shot feel is poor. On the other hand, when the amount of the co-crosslinking agent is smaller than 15 parts by weight, the center is soft. Therefore the rebound characteristics are degraded, which reduces flight distance.

The organic peroxide, which acts as a crosslinking agent or curing agent, includes for example dicumyl peroxide, 1,1-bis(t-butylperoxy)-3,3,5-trimethylcyclohexane, 2,5-dimethyl-2,5-di(t-butylperoxy)-hexane, di-t-butyl peroxide and the like. The preferred organic peroxide is dicumyl peroxide. The amount of the organic peroxide is not limited, but may be from 0.3 to 3.0 parts by weight, preferably 0.5 to 2.5 parts by weight, based on 100 parts by weight of the base rubber. When the amount of the organic peroxide is smaller than 0.3 parts by weight, the center is too soft. Therefore the rebound characteristics are degraded, which reduces flight distance. On the other hand, when the amount of the organic peroxide is larger than 3.0 parts by weight, the center is too hard, and the shot feel is poor.

The filler, which can be used for the core of the golf ball, includes for example, an inorganic filler (such as zinc oxide, barium sulfate, calcium carbonate, and the like), a high specific gravity metal powder (such as tungsten powder, molybdenum powder, and the like), and mixture thereof. When the amount of the filler is smaller than 30 parts by weight, the center is too light, and the resulting golf ball is too light. On the other hand, when the amount of the filler is larger than 65 parts by weight, the center is too heavy and the resulting golf ball is too heavy.

The rubber composition for the center of the present invention can contain other components, which have been conventionally used for preparing the core of solid golf balls, such as antioxidants or peptizing agents such as an organic sulfide compound. The amount of the antioxidant is preferably 0.2 to 0.5 parts by weight based on 100 parts by weight of the base rubber.

The rubber composition used for the center of the present invention may be vulcanized the base rubber by using the organic peroxide, or by using sulfur. When vulcanized by using sulfur, a vulcanizable rubber composition can be obtained by vulcanizing a rubber composition prepared by formulating sulfur, zinc oxide, stearic acid, a vulcanization accelerator, zinc stearate and the like to the base rubber.

The center is obtained by mixing the rubber composition in an internal mixer (a Banbury mixer or a kneader), or a mixing roll, followed by vulcanizing or press-molding the rubber composition at 130 to 170° C. for 15 to 40 minutes in a mold. In the thread wound golf ball of the present invention, the center has a diameter of 27 to 36 mm, preferably 29 to 33 mm. When the diameter of the center is smaller than 27 mm, the launch angle is low, the spin amount at the time of hitting increases and the flight distance is reduced. On the other hand, when the diameter of the solid center is larger than 36 mm, the thread rubber layer is too thin, and the shot feel is poor.

The center has a deformation amount of 4.0 to 15.0 mm, preferably 4.0 to 13.0 mm when applying from an initial load of 10 kgf to a final load of 130 kgf. When the deformation amount is larger than 15.0 mm, the center is too soft, and the rebound characteristics are degraded. On the other hand, when the deformation amount is smaller than 4.0 mm, the center is too hard, and impact force at the time of hitting is large. The thread rubber layer 3 is then formed on the resulting center.

The thread rubber wound on the center 1 can be the same one as that which has been conventionally used in the thread rubber layer of the thread wound golf balls. For example, the thread rubber can be one that is obtained by vulcanizing a rubber composition prepared by formulating sulfur, a vulcanization accelerator, a vulcanization aid, an antioxidant and the like to a natural rubber or a blend rubber of the natural rubber and a synthetic polyisoprene. The thread rubber is wound on the center by conventional methods which have used for the thread wound core of the thread wound golf balls. The thread rubber layer 3 may have a thickness of 1.4 to 10.0 mm, preferably 1.5 to 8.0 mm. When the thickness of the thread rubber layer is smaller than 1.4 mm, the thread rubber layer is too thin to exhibit sufficient impact relaxation, and the shot feel is poor. On the other hand, when the thickness is larger than 10.0 mm, the spin amount at the time of hitting increases and the flight distance is reduced.

Thread rubber layer 2 is formed on the center 1 to obtain the thread wound core 5. The core 5 has a deformation amount of 3.0 to 8.0 mm, preferably 3.5 to 7.0 mm when applying from an initial load of 10 kgf to a final load of 130 kgf. When the deformation amount is larger than 8.0 mm, the resulting golf ball is too soft, and the rebound characteristics are degraded. On the other hand, when the deformation amount is smaller than 3.0 mm, the center is too hard, and impact force at the time of hitting is large.

In the golf ball of the present invention, a ratio of the deformation amount of the core to the deformation amount of the center {(the deformation amount of the core)/(the deformation amount of the center)} is not more than 0.9, preferably not more than 0.7. When the ratio is more than 0.9, the thread rubber layer 2 is too soft, and the rebound characteristics are degraded. It is required to increase the hardness of the thread rubber layer in order to reduce the ratio of the deformation amount. However, when the thread rubber having high stiffness, it is difficult to wind the thread rubber on the center. Therefore the ratio of the deformation amount may be limited to not less than 0.4, preferably not less than 0.5. The cover 6 is then formed on the thread wound core 5.

The cover 6 of the present invention has a two-layer structure composed of an inner cover 3 and an outer cover 4. The material used for the both covers includes thermoplastic resin, particularly ionomer resin or mixtures thereof The ionomer resin may be a copolymer of α-olefin and α,β-unsaturated carboxylic acid having 3 to 8 carbon atoms, of which a portion of carboxylic acid groups is neutralized with metal ion. Examples of the α-olefins in the ionomer preferably include ethylene, propylene and the like. Examples of the α,β-unsaturated carboxylic acid in the ionomer preferably include acrylic acid, methacrylic acid and the like. The metal ion which neutralizes a portion of carboxylic acid groups of the copolymer includes an alkali metal ion, such as a sodium ion, a potassium ion, a lithium ion and the like; a divalent metal ion, such as a zinc ion, a calcium ion, a magnesium ion and the like; a trivalent metal ion, such as an aluminum, a neodymium ion and the like; and mixture thereof. Preferred are sodium ions, zinc ions, lithium ions and the like, in view of rebound characteristics, durability and the like. The ionomer resin is not limited, but examples thereof will be shown by a trade name thereof. Examples of the ionomer resins, which are commercially available from Mitsui Du Pont Polychemical Co., Ltd. include Hi-milan 1555, Hi-milan 1557, Hi-milan 1605, Hi-milan 1652, Hi-Milan 1705, Hi-Milan 1706, Hi-Milan 1707, Hi-Milan 1855, Hi-Milan 1856 and the like. Examples of the ionomer resins, which are commercially available from Du Pont Co., include Surlyn AD8511, Surlyn AD8512, Surlyn AD8542, Surlyn AD8945, Surlyn AD9945 and the like. Examples of the ionomer resins, which are commercially available from Exxon Chemical Co., include lotek 7010, Iotek 8000 and the like. These ionomer resins may be used alone or in combination.

As the materials used in the cover 6 of the present invention, the above ionomer resin may be used alone, but the ionomer resin may be suitably used in combination with a specific elastomer or resin. Examples of the combinations thereof include:

(i) a heat mixture of an ionomer resin, an acid-modified thermoplastic elastomer or thermoplastic elastomer having terminal OH groups, and an SBS (styrene-butadiene-styrene) block copolymer having polybutadiene portion with epoxy groups or SIS (styrene-isoprene-styrene) block copolymer having polyisoprene portion with epoxy groups, (ii) a heat mixture of an ionomer and a terpolymer of ethylene-unsaturated carboxylic acid ester-unsaturated carboxylic acid, (iii) a heat mixture of an ionomer, a maleic anhydride-modified thermoplastic elastomer and a glycidyl group-modified thermoplastic elastomer. In the cover composition of the present invention, a ratio of the ionomer resin to the specific elastomer or resin (the acid-modified thermoplastic elastomer or thermoplastic elastomer having terminal OH groups, the epoxy group-modified thermoplastic elastomer, the maleic anhydride-modified thermoplastic elastomer and the terpolymer of ethylene-unsaturated carboxylic acid ester-unsaturated carboxylic acid) is preferably 95:5 to 55:45.

Examples of the terminal OH-containing thermoplastic elastomer include hydrogenated styrene-isoprene-styrene (SIS) block copolymers having terminal OH groups, which is commercially available from Kuraray Co., Ltd. under the trade name of "Cepton HG-252", and the like.

Examples of the epoxy group-modified thermoplastic elastomer, which has epoxy groups in elastomer molecule, include styrene-butadiene-styrene (SBS) block copolymers having polybutadiene block with epoxy groups, which are commercially available from Daicel Chemical Industries Co., Ltd. under the trade name of "Epofriend A1010", "Epofriend A1005", "Epofriend A1020" and the like.

Examples of the terpolymer of ethylene-unsaturated carboxylic acid ester-unsaturated carboxylic acid include ethylene-isobutyl acrylate-methacrylic acid terpolymer, which is commercially available from Mitsui Du Pont Polychemical Co., Ltd. under the trade name of "Neucrel AN4212C", "Neucrel N0805J" and the like.

Examples of the maleic anhydride-modified thermoplastic elastomer include maleic anhydride adducts of hydrogenated styrene-butadiene-styrene block copolymers, which are commercially available from Asahi Chemical Industries Co., Ltd. under the trade name of "Taftek M" series; ethylene-ethyl acrylate-maleic anhydride terpolymers, which are commercially available from Sumitomo Chemical Industries Co., Ltd. under the trade name of "Bondine"; and products obtained by graft-modifying ethylene-ethyl acrylate copolymers with maleic anhydride, which are commercially available from Mitsui Du Pont Polychemical Co., Ltd. under the trade name of "AR" series. They are suitably used in the present invention.

Examples of the glycidyl group-modified thermoplastic elastomer include ethylene-glycidyl methacrylate copolymer, ethylene-glycidyl methacrylate-methyl acrylate terpolymer, ethylene-glycidyl methacrylate-vinyl acetate terpolymer, which are commercially available from Sumitomo Chemical Industries Co., Ltd. under the trade name of "Bondfast"; glycidyl methacrylate adducts of hydrogenated styrene-butadiene-styrene (SBS) block copolymers, which are commercially available from Asahi Chemical Industries Co., Ltd. under the trade name of "Taftek Z514", "Taftek Z513" and the like; adducts of ethylene-acrylic ester-glycidyl methacrylate terpolymer, which are commercially available from Du Pont U.S.A. under the trade name of "Elvaloy-AS". Although the glycidyl group is broadly classified into the epoxy group, the term "glycidyl group" herein is used for making clear the difference between epoxy group and glycidyl group. Accordingly, the "glycidyl group" in this specification is different from the "epoxy group".

In case of employing the combination of ionomer resin and the other resin, it is required to heat mixing the both. The heat mixing is typically conducted by mixing for 1 to 20 minutes, and practically conducted in a extruder with controlling temperature.

In the golf ball of the present invention, the cover composition may optionally contain fillers (such as barium sulfate, etc.), pigments (such as titanium dioxide, etc.), and other additives (such as a dispersant, an antioxidant, a UV absorber, a photostabilizer and a fluorescent agent or a fluorescent brightener, etc.), in addition to the resin component, as long as the addition of the additive does not deteriorate the desired performance of the golf ball cover. However, the amount of the pigment is preferably from 1.0 to 6.0 parts by weight based on 100 parts by weight of the cover resin.

The cover of the present invention, i.e. both the inner cover 3 and the outer cover 4, may be formed by conventional methods, which have been known to the art and used for forming the cover of the golf balls. For example, there can be used a method comprising molding the cover composition into a semi-spherical half-shell, covering the thread wound core or the inner cover covering thread wound core with the two half-shells, followed by pressure molding at 130 to 170° C. for 1 to 5 minutes, or a method comprising injection molding the cover composition directly on the thread wound core or the inner cover covering thread wound core to cover it.

In the cover 6 of the present invention, it is required the outer cover 4 has higher hardness than the inner cover 3, preferably the hardness difference between the inner cover and the outer cover in Shore D hardness is not less than 2, more preferably not less than 5. When the hardness difference is too large, the deformation amount difference between the inner cover and the outer cover is too large, and the durability of the resulting golf ball is degraded. Therefore the hardness difference can be limited to not more than 40, preferably not more than 20. It is required that the outer cover 4 has a Shore D hardness of not less than 65, preferably 65 to 75, more preferably 65 to 70. When the Shore D hardness of the outer cover 4 is lower than 65, the spin amount of the resulting golf ball is too large, and the flight distance is reduced. On the other hand, when the Shore D hardness of the outer cover 4 is too high, the cover is too hard, and the shot feel of the resulting golf ball is hard and poor. Therefore the Shore D hardness of the outer cover 4 can be limited to not more than 75, preferably not more than 70.

The inner cover 3 of the present invention has a Shore D hardness of 25 to 70, preferably 30 to 65. When the hardness is lower than 25, the cover is too soft, and the rebound characteristics of the resulting golf ball are degraded. On the other hand, when the hardness is higher than 70, the cover is too hard, and the shot feel of the resulting golf ball is hard and poor. The term "hardness of an inner cover" refers to the surface hardness in Shore D hardness of the spherical article, which is obtained by covering the thread wound core with the inner cover. The term "hardness of an outer cover" refers to the surface hardness in Shore D hardness of the golf ball, which is obtained by covering the spherical article with the outer cover.

In the golf ball of the present invention, the hardness of the outer cover 4 is higher than that of the inner cover 3, in order to improve the rebound characteristics by hardening the outer cover and reduce the spin amount as much as possible, and make the shot feel light. When the hardness of the outer cover 4 is not more than that of the inner cover 3, the spin amount is large and the flight distance is reduced, and the shot feel is heavy any poor.

The cover has a thickness of 2.5 to 5.0 mm, preferably 2.5 to 4.5 mm, as a total thickness of the inner cover and the outer cover. When the thickness of the cover is smaller than 2.5 mm, the cover is too thin and the durability is degraded. On the other hand, when the thickness is larger than 5.0 mm, the cover is too thick and the shot feel is poor (the impact force at the time of hitting is large). The outer cover 4 preferably has a thickness of 0.5 to 2.0 mm. When the thickness is smaller than 0.5 mm, the durability is degraded. on the other hand, when the thickness is larger than 2.0 mm, the shot feel is poor. The inner cover 3 has a thickness of 0.5 to 4.5 mm, preferably 0.5 to 3.0 mm. When the thickness is smaller than 0.5 mm, the thickness of the outer cover is larger than 2.0 mm, and the shot feel is poor. On the other hand, when the thickness is larger than 4.5 mm, the thickness of the outer cover is smaller than 0.5 mm, and the durability is degraded.

At the time of molding the outer cover, many depressions called "dimples" may be optionally formed on the surface of the golf ball. Furthermore, paint finishing or marking with a stamp may be optionally provided after the cover is molded for commercial purposes. The golf ball of the present invention may have a diameter of 1.680 to 1.690 inches (42.67 to 42.93 mm), because it has a diameter of not less than 1.680 inches (42.67 mm) according to the R & A rule.

EXAMPLES

The following Examples and Comparative Examples further illustrate the present invention in detail but are not to be construed to limit the scope of the present invention.

Production of Center

Each spherical center was obtained by mixing the rubber composition for the solid center having the formulation shown in Tables 1 and 2, and press-molding the mixture at the condition shown in the same tables. A diameter, a weight and a deformation amount when applying from an initial load of 10 kgf to a final load of 130 kgf of the resulting center were measured, and the results are shown in Table 4.

TABLE 1

| | | (parts by weight) Example No. | | |
|---|---|---|---|---|
| Center composition | | 1 | 2 | 3 |
| BR-11 *1 | | 100 | 100 | 100 |
| Zinc acrylate | | 17 | — | — |
| Zinc oxide | | 20 | 4.5 | 4.5 |
| Barium sulfate | | — | 42 | 51.5 |
| Tungsten | | 30 | — | — |
| Stearic acid | | — | 2 | 2 |
| Nipol 2007J *2 | | — | 32 | — |
| Diphenyl disulfide | | 0.5 | — | — |
| Dicumyl peroxide | | 1.4 | — | — |
| Sulfur | | — | 10.5 | 10.5 |
| Vulcanization accelerator | | — | 1.0 | 1.25 |
| Vulcanization condition | | | | |
| The first stage | Temp. (° C.) | 140 | 157 | 157 |
| | Time (min) | 17 | 27 | 27 |
| The second stage | Temp. (° C.) | 165 | — | — |
| | Time (min) | 8 | — | — |

TABLE 2

| | | (parts by weight) Example No. | | | | |
|---|---|---|---|---|---|---|
| Center composition | | 1 | 2 | 3 | 4 | 5 |
| BR-11 *1 | | 100 | 100 | 100 | 100 | 100 |
| Zinc acrylate | | 17 | — | 27 | — | 24 |
| Zinc oxide | | 20 | 4.5 | 15 | 4.5 | 21.5 |
| Barium sulfate | | — | 42 | 20 | 51.5 | — |
| Tungsten | | 30 | — | — | — | — |
| Stearic acid | | — | 2 | — | 2 | — |
| Nipol 2007J *2 | | — | 32 | — | — | — |
| Diphenyl disulfide | | 0.5 | — | 0.5 | — | 0.5 |
| Dicumyl peroxide | | 1.4 | — | 1.2 | — | 1.4 |
| Sulfur | | — | 10.5 | — | 10.5 | — |
| Vulcanization accelerator | | — | 1.0 | — | 1.25 | — |
| Vulcanization condition | | | | | | |
| The first stage | Temp.(° C.) | 140 | 157 | 140 | 157 | 157 |
| | Time(min) | 17 | 27 | 22 | 27 | 24 |
| The second stage | Temp.(° C.) | 165 | — | 165 | — | — |
| | Time(min) | 8 | — | 8 | — | — |

*1High-cis polybutadiene (trade name "BR-11") from JSR Co., Ltd., Content of 1,4-cis-polybutadiene: 96%
*2High-styrene resin (trade name "Nipol 2007J") from Nippon Zeon Co., Ltd.
*3Vulcanization accelerator (trade name "Nocceler CZ") cyclohexylbenzothiazyl sulfenamide from Ouchi Shinko Chemical Industries Co., Ltd.

Formation of Thread Rubber Layer

Each thread rubber layer was then formed on the solid center by winding the thread rubber. The thread rubber was prepared from a blend of natural rubber and a low cis-isoprene rubber ("Shell IR-309" commercially available from Shell Chemical Co., Ltd.)=50/50 (weight ratio). A diameter, a weight and a deformation amount when applying from an initial load of 10 kgf to a final load of 130 kgf of the resulting thread wound core were measured, and the results are shown in Table 4.

Preparation of Cover Composition

The formulation materials shown in Table 3 were mixed using a kneading type twin-screw extruder to obtain pelletized cover compositions. The extrusion condition were a screw diameter of 45 mm, a screw speed of 200 rpm, and a screw L/D of 35.

The formulation materials were heated at 200 to 260° C. at the die position of the extruder.

TABLE 3

| Cover composition | A | B | C | D | E | F |
|---|---|---|---|---|---|---|
| | | | | (parts by weight) | | |
| Hi-milan 1706 *4 | — | — | — | — | 25 | 30 |
| Hi-milan 1707 *5 | — | — | — | 30 | — | 30 |
| Hi-milan 1605 *6 | — | 5 | — | — | — | 40 |
| Hi-milan 1855 *7 | — | 85 | — | 50 | — | — |
| Hi-milan 1555 *8 | — | 10 | — | — | 25 | — |
| Hi-milan 1557 *9 | — | — | — | 20 | — | — |
| Surlyn AD8945 *10 | 25 | — | — | — | — | — |
| Surlyn AD9945 *11 | 25 | — | — | — | — | — |
| Surlyn AD8542 *12 | — | — | — | — | 30 | — |
| Cepton HG-252 *13 | 35 | — | 100 | — | — | — |
| Epofriend A1010 *14 | 15 | — | — | — | 8 | — |
| Pebax 2533 *15 | — | — | — | — | 12 | — |

*4: Hi-milan 1706 (trade name), ethylene-methacrylic acid copolymer ionomer resin obtained by neutralizing with zinc ion, manufactured by Mitsui Du Pont Polychemical Co., Ltd.
*5: Hi-milan 1707 (trade name), ethylene-methacrylic acid copolymer ionomer resin obtained by neutralizing with sodium ion, manufactured by Mitsui Du Pont Polychemical Co.
*6: Hi-milan 1605 (trade name), ethylene-methacrylic acid copolymer ionomer resin obtained by neutralizing with sodium ion, manufactured by Mitsui Du Pont Polychemical Co., Ltd.
*7: Hi-milan 1855 (trade name), ethylene-butyl acrylate-methacrylic acid terpolymer ionomer resin obtained by neutralizing with zinc ion, manufactured by Mitsui Du Pont Polychemical Co., Ltd.
*8: Hi-milan 1555 (trade name), ethylene-methacrylic acid copolymer ionomer resin obtained by neutralizing with sodium ion, manufactured by Mitsui Du Pont Polychemical Co., Ltd.
*9: Hi-milan 1557 (trade name), ethylene-methacrylic acid copolymer ionomer resin obtained by neutralizing with zinc ion, manufactured by Mitsui Du Pont Polychemical Co., Ltd.
*10: Surlyn AD8945 (trade name), ethylene-methacrylic acid copolymer ionomer resin obtained by neutralizing with sodium ion, manufactured by Du Pont Co.
*11: Surlyn AD9945 (trade name), ethylene-methacrylic acid copolymer ionomer resin obtained by neutralizing with zinc ion, manufactured by Du Pont Co.
*12: Surlyn AD8542 (trade name), ethylene-methacrylic acid copolymer ionomer resin obtained by neutralizing with sodium ion, manufactured by Du Pont Co.
*13: Cepton HG-252 (trade name), hydrogenated styrene-isoprene-styrene block copolymer having a terminal OH group, manufactured by Kuraray Co. Ltd., JIS-A hardness = 80, content of styrene = about 40% by weight
*14: Epofriend A1010 (trade name), styrene-butadiene-styrene structure block copolymer having a polybutadiene block with epoxy groups, manufactured by Daicel Chemical Industries, Ltd., styrene/butadiene (weight ratio) = 40/60, JIS-A hardness = 67, content of epoxy: about 1.5 to 1.7% by weight
*15: Pebax 2533 (trade name), polyamide thermoplastic elastomer, manufactured by ELF Atochem Co.

(Examples 1 to 3 and Comparative Examples 1, 3 and 5)

Inner cover

The cover compositions shown in Table 4 were preliminary molded into semi-spherical half-shells, encapsulating the resulting thread wound core with the two half-shells, followed by press-molding in the mold at 140 to 170° C. for 1 to 5 minutes to form an inner cover on the thread wound core. Shore D hardness and thickness of the resulting inner cover were measured, and the results are shown in Table 4.

Outer Cover

The cover compositions shown in Table 4 were preliminary molded into semi-spherical half-shells, encapsulating the resulting inner cover with the two half-shells, followed by press-molding in the mold at 140 to 170° C. for 1 to 5 minutes to form an outer cover on the inner cover. Shore D hardness and thickness of the resulting outer cover were measured, and the results are shown in Table 4. A thread wound golf ball was obtained by coating the surface of the outer cover with a paint. Deformation amount when applying from an initial load of 10 kgf to a final load of 130 kgf, durability, flight performance (launch angle, spin amount, carry and total as flight distance) and shot feel of the resulting golf ball were measured or evaluated, and the results are shown in Tables 5 (Examples) and Table 6 (Comparative Examples). The test methods are as described later.

Comparative Examples 2 and 4

A golf ball was obtained as described in Examples 1 to 3 and Comparative Examples 1, 3 and 5, except that the cover was composed of only the outer cover (the cover has a single-layer structure). Shore D hardness and thickness of the resulting outer cover were measured, and the results are shown in Table 4. The results are shown in Table 4. Deformation amount when applying from an initial load of 10 kgf to a final load of 130 kgf, durability, flight performance (launch angle, spin amount, carry and total as flight distance) and shot feel of the resulting golf ball were measured or evaluated, and the results are shown in Tables 5 (Examples) and Table 6 (Comparative Examples). The test methods are as follows.

Test Method (1) Durability

A golf ball was struck against a metal board by using an air gun at a speed of 45 m/second, repeatedly. The durability is the number of strike until the cover of the golf ball cracks, and is indicated by an index when that of Example 3 is 100. When the number is not less than 100, the golf ball can be put to practice use.

(2) Flight Performance

After a No. 1 wood club (a driver, W#1) was mounted to a swing robot manufactured by True Temper Co. and a golf ball was hit at head speed of 45 m/sec, the initial velocity, spin amount and flight distance were measured. The spin amount was measured by continuously taking a photograph of a mark provided on the hit golf ball using a high-speed camera. As the flight distances, carry which is a distance to the dropping point of the hit golf ball, and total (total distance) were measured.

(3) Shot Feel

The shot feel of the golf ball is evaluated by 10 professional golfers according to a practical hitting test using a No. 1 wood club. The evaluation criteria are as follows. The results shown in the Tables below are based on the fact that not less than 8 out of 10 professional golfers evaluated with the same criteria.

Evaluation criteria:

○: Not less than 8 out of 10 golfers felt that the golf ball has soft and good shot feel.

X: Not less than 8 out of 10 golfers felt that the golf ball has hard and poor shot feel.

Test Results

TABLE 4

| | Example No. | | | Comparative Example No. | | | | |
|---|---|---|---|---|---|---|---|---|
| Test item | 1 | 2 | 3 | 1 | 2 | 3 | 4 | 5 |
| (Center) | | | | | | | | |
| Diameter (mm) | 28 | 32 | 30 | 28 | 32 | 36 | 30 | 34 |
| Weight (g) | 16.1 | 21.0 | 18.6 | 16.1 | 21.0 | 30.0 | 18.6 | 23.5 |
| Deformation amount a (mm) | 5.55 | 8.5 | 11.2 | 5.55 | 8.5 | 3.45 | 11.2 | 4.05 |

TABLE 4-continued

| Test item | Example No. 1 | 2 | 3 | Comparative Example No. 1 | 2 | 3 | 4 | 5 |
|---|---|---|---|---|---|---|---|---|
| (Thread wound core) | | | | | | | | |
| Diameter (mm) | 37 | 37 | 37 | 37 | 40 | 40 | 37 | 37 |
| Weight (g) | 28.0 | 28.0 | 28.0 | 28.0 | 35.5 | 35.5 | 28.0 | 28.0 |
| Deformation amount b (mm) | 3.90 | 4.80 | 6.00 | 3.90 | 3.50 | 3.00 | 6.00 | 3.85 |
| b/a | 0.70 | 0.56 | 0.54 | 0.70 | 0.41 | 0.87 | 0.54 | 0.95 |
| (Inner cover) | | | | | | | | |
| Composition | A | B | D | F | — | C | — | E |
| Shore D hardness (P) | 50 | 60 | 65 | 70 | — | 30 | — | 56 |
| Thickness (mm) | 1.9 | 1.9 | 1.9 | 1.9 | — | 1.0 | — | 1.9 |
| (Outer cover) | | | | | | | | |
| Composition | F | D | F | B | F | A | F | B |
| Shore D hardness (Q) | 70 | 65 | 70 | 60 | 70 | 50 | 70 | 60 |
| Thickness (mm) | 1.9 | 1.9 | 1.9 | 1.9 | 1.9 | 1.0 | 3.8 | 1.9 |
| Q-P | 20 | 5 | 5 | −10 | 0 | 20 | 0 | 4 |

TABLE 5

| Test item | Example No. 1 | 2 | 3 |
|---|---|---|---|
| (Golf ball) | | | |
| Deformation amount (mm) | 2.95 | 4.05 | 3.50 |
| Durability | 130 | 140 | 100 |
| Flight performance (W#1, 45 m/sec) | | | |
| Launch angle (degree) | 11.40 | 11.73 | 11.65 |
| Spin amount (rpm) | 2788 | 2635 | 2655 |
| Carry (yard) | 230.1 | 229.8 | 230.7 |
| Total (yard) | 251.2 | 250.5 | 252.3 |
| Shot feel | ○ | ○ | ○ |

TABLE 6

| Test item | Comparative Example No. 1 | 2 | 3 | 4 | 5 |
|---|---|---|---|---|---|
| (Golf ball) | | | | | |
| Deformation amount (mm) | 2.95 | 3.35 | 3.05 | 3.45 | 3.35 |
| Durability | 170 | 80 | 200 | 130 | 140 |
| Flight performance (W#1, 45 m/sec) | | | | | |
| Launch angle (degree) | 11.22 | 11.43 | 10.91 | 11.25 | 11.35 |
| Spin amount (rpm) | 2822 | 2773 | 3125 | 2790 | 2766 |
| Carry (yard) | 227.2 | 229.5 | 225.1 | 228.1 | 224.5 |
| Total (yard) | 246.5 | 250.3 | 246.3 | 248.3 | 245.6 |
| Shot feel | X | ○ | ○ | X | ○ |

As is apparent from Table 4to Table 6, the golf balls of Examples 1 to 3 had longer flight distance than the conventional thread wound golf balls of Comparative Examples, and soft and good shot feel which evaluated by professional golfers.

On the other hand, the golf ball of Comparative Example 1 has large spin amount and short flight distance, because the hardness of the outer cover is lower than that of the inner cover. The golf ball has large spin amount, and the rebound characteristics are degraded, which reduces the flight distance, because the hardness of the outer cover in Shore D hardness is less than 65. The golf ball has hard and poor shot feel, because the hardness of the outer cover is small, but the hardness of the inner cover is large.

In the golf ball of Comparative Example 2, the durability is very poor, because the cover has a single-layer structure and the cover thickness is small. In the golf ball of Comparative Example 3, the hardness of the outer cover is higher than that of the inner cover, but the spin amount is large, and the rebound characteristics are degraded, which slightly reduces the flight distance, because the hardness of the outer cover in Shore D hardness is less than 65. The golf ball has shorter flight distance than the golf balls of Examples, because of employing a thread wound core having smaller deformation amount than the golf balls of Examples in order to compensate for deterioration of the rebound characteristics caused by small cover hardness.

In the golf ball of Comparative Example 4, the durability is excellent, but the shot feel is hard and poor, because the cover has a single-layer structure and the cover hardness is too large. In the golf ball of Comparative Example 5, the hardness of the outer cover is higher than that of the inner cover, but the spin amount is large, and the flight distance is small, because the hardness of the outer cover in Shore D hardness is less than 65. And the thread rubber layer is too soft, and the rebound characteristics are degraded, which reduces the flight distance, because the ratio of deformation amount of the core to that of the center is large.

What is claimed is:

1. A thread wound golf ball comprising a thread wound core composed of a center and a thread rubber layer formed on the center, and a cover composed of an inner cover formed on the thread rubber layer and an outer cover formed on the inner cover, wherein the outer cover has higher hardness than the inner cover, and has a Shore D hardness of not less than 65 and the center has a diameter of 27 to 36 mm, and a ratio of the deformation amount of the core to the deformation amount of the center when applying from an initial load of 10 kgf to a final load of 130 kgf is not more than 0.9.

2. The thread wound golf ball according to claim 1, wherein the golf ball has a deformation amount of 2.8 to 4.5 mm when applying from an initial load of 10 kgf to a final load of 130 kgf.

3. The thread wound golf ball according to claim 1, wherein the core has a deformation amount of 3.0 to 8.0 mm when applying from an initial load of 10 kgf to a final load of 130 kgf.

4. The thread wound golf ball according to claim 1, wherein the center has a deformation amount of 4.0 to 15.0 mm when applying from an initial load of 10 kgf to a final load of 130 kgf.

5. The thread wound golf ball according to claim 1, wherein the ratio of the deformation amount of the core to the deformation amount of the center is 0.4 to 0.9.

6. The thread wound golf ball according to claim 1, wherein the outer cover has a Shore D hardness of 65 to 75.

7. The thread wound golf ball according to claim 1, wherein the inner cover has a Shore D hardness of 25 to 70.

8. The thread wound golf ball according to claim 1, wherein the Shore D hardness difference between the outer cover and the inner cover is 5 to 40.

9. The thread wound golf ball according to claim 1, wherein the cover has a thickness of 2.5 to 5.0 mm, as a total thickness of the inner cover and the outer cover.

* * * * *